United States Patent [19]

Müller et al.

[11] 3,951,307

[45] Apr. 20, 1976

[54] TIMING OF THE CONTROL AND RESETTING MOTOR IN A FUEL DISPENSING ARRANGEMENT

[75] Inventors: Felix Müller; Dietmar Hummel; Bernhard Müller, all of Schwenningen, Germany

[73] Assignee: Kienzle Apparate GmbH, Villingen, Germany

[22] Filed: July 10, 1974

[21] Appl. No.: 487,274

[30] Foreign Application Priority Data

July 11, 1973 Germany ..... 2335241

[52] U.S. Cl. ..... 222/33; 235/94 A; 235/92 FL

[51] Int. Cl.[2] ..... B67D 5/26

[58] Field of Search ..... 222/32, 33, 23, 54, 222/35, 74, 75, 76; 235/94 A, 92 FL

[56] References Cited

UNITED STATES PATENTS

| | | | |
|---|---|---|---|
| 3,187,945 | 6/1965 | Wright et al. | 222/35 |
| 3,188,005 | 6/1965 | Wright et al. | 222/35 X |
| 3,216,659 | 11/1965 | Ambler et al. | 222/35 X |
| 3,447,719 | 6/1969 | Bottling | 222/35 X |
| 3,618,823 | 11/1971 | Kruckeberg | 222/35 |
| 3,662,866 | 9/1970 | Conte | 222/33 |
| 3,692,212 | 9/1972 | Irie et al. | 222/32 |
| 3,720,370 | 3/1973 | Young | 222/33 |
| 3,840,151 | 10/1974 | Jarvis | 222/33 |

*Primary Examiner*—Allen N. Knowles
*Attorney, Agent, or Firm*—Michael S. Striker

[57] ABSTRACT

The fuel dispensing arrangement includes a fuel dispensing nozzle, a fuel pump for pumping fuel to the fuel dispensing nozzle, an electric pump motor operative when energized by pump motor current for driving the fuel pump, a price calculator and indicator arrangement for calculating and indicating the price of the fuel pumped through the nozzle, a resetting arrangement which can be driven to effect resetting of the price calculator and indicator arrangement, and an electric control motor operative for driving the resetting arrangement. A source of electrical energy is connected to the pump motor by way of a pump motor current path for the flow of pump motor current. The operation of the control motor is controlled in dependence upon the flow of pump motor current.

13 Claims, 4 Drawing Figures

TIMING OF THE CONTROL AND RESETTING MOTOR IN A FUEL DISPENSING ARRANGEMENT

BACKGROUND OF THE INVENTION

In order to make the operation of fuel dispensers as trouble-free as possible, the most recent designs to a very great extent make use of automatic control arrangements which permit the proper control of a fuel dispensing cycle simply by removing the fuel-dispensing nozzle from its support or housing and, after a desired amount of fuel has been dispensed, replacing the fuel-dispensing nozzle onto its support or into its housing. Known fuel dispensers make use of an automatic clearing or resetting arrangement for the price and volume indicators of the price calculating arrangement of the fuel dispenser; the resetting arrangement always resets the indicators when the dispensing nozzle is removed from its support or housing. In response to the completion of the resetting of the digit rollers of the volume and price indicators, a switch is activated by means of a connecting arrangement incorporating gearing, and activation of such switch results in the supply of operating current to the motor of the pump of the fuel dispenser. After the desired amount of fuel has been dispensed, the fuel-dispenser pump motor is, again automatically, turned off when the dispensing nozzle is replaced upon its support hook or returned to its support housing.

For the automatic resetting of the price calculator of the fuel dispenser it is already known to employ an electromechanical resetting arrangement incorporating an electrical drive motor for causing the resetting operation to be performed. German published patent application No. 1,212,752 discloses an automatic arrangement for controlling the resetting operation of the price calculator of the fuel dispenser and for initiating and terminating operation of the motor of the pump of the fuel dispenser; in this known arrangement a cam disk is driven by the resetting motor of the price calculator and controls an electrical multiple switch. This multiple switch, on the one hand, together with a main switch activated by the dispensing nozzle, controls the resetting motor, and, on the other hand, controls the relay winding of a relay device whose relay switch turns the motor of the pump of the fuel dispenser on and off.

This known control arrangement has the disadvantage that the resetting of the price calculator is not necessarily completed, in the event the dispensing nozzle is only briefly removed from its support and then almost immediately replaced. As a result, the resetting of the digit wheels of the price calculator can be interrupted by the operator of the fuel dispenser, simply by removing the dispensing nozzle from its support and then quickly replacing it; if the dispensing nozzle is replaced quickly enough, before the resetting of the digit wheels is completed, a combination of digits can appear on the digit wheel arrangement corresponding neither to an amount of fuel which has actually been dispensed nor to the number zero. In order to preclude the performance of computations based upon meaningless values, such as could result in the manner just described, it is necessary to preclude the possibility of interrupting the resetting of the digit wheels. Indeed, with this known construction, the rotating control structure can be stopped at any desired point in the cycle of rotating thereof, i.e., either during the first portion of the cycle during which the price calculator is reset, or else during the second portion of the cycle which is required for turning off the pump motor and for preparing the arrangement for the next resetting operation. Furthermore, with this known construction, there is no guarantee of an avoidance of damaging overlaps in the energization of the resetting motor and the energization of the pump motor, since with the multiple switch merely the working winding of the pump motor switch is controlled. The actual state of energization of the pump motor—i.e., whether or not the pump motor is energized—relative to the state of energization of the resetting motor is simply not determined, and accordingly a direct interdependence between the energization of the two motors does not exist.

U.S. Pat. No. 3,216,659 discloses another electromotor-driven resetting arrangement. In this arrangement, the initiation of the resetting operation is effected by means of a manually activated lever connected to a rotary switch. When the lever is moved to activated position, it becomes mechanically locked in such position, and remains locked until the resetting operation has been completed, whereupon the pump motor of the fuel dispenser is turned on. This locking of the manually activated control lever at the start of the control cycle for the resetting operation is accomplished by means of a cooperating series of mechanical components, and furthermore the control lever actually activates the electrical switch for the resetting motor only through the intermediary of numerous mechanical coupling elements. The mechanical locking of the manually activated control lever used to initiate the resetting operation is caused to terminate by a quite complicated gearing mechanism which is operative upon completion of the resetting operation for releasing a locking member in the counting mechanism and which is furthermore operative for connecting the pump motor circuit to power. Furthermore, when the manually activated control lever is released from its locked position and permitted to return to the non-activated position, the actual deactivation of the resetting motor and the pump motor switch is very indirect, being accomplished through the intermediary of a plurality of mechanically driven control cams and catch devices which cooperate and move relative to each other in a predetermined succession in order to move the control switches for the resetting motor and for the pump motor switch to the deactivated positions. The complexity of the mechanical components and control elements is very great, and furthermore proper cooperation between these mechanical components and control elements in the correct order with the correct relative timing makes it very difficult to perform adjustments upon the mechanisms. Also of disadvantage is the fact that the locking of the manually activated lever does not occur directly by means of the pump motor itself, and also the turning off of the pump motor again can be performed only by way of the manually activated mechanism mounted on the price calculator. For these reasons, this arrangement is furthermore not suited for remote control of the price calculator.

Another known construction provides, for the turning on of the pump motor, a switch additionally provided with an interruptor contact for turning off the resetting motor. This switch is controlled by a cam disk driven by a one-revolution clutch. The cam disk activates a sliding member which through the intermediary of a further coupling member brings the switch into the turn-on position for the pump motor. Finally, the switch is maintained in such turn-on position by means of an additional locking device. It is desired that the cam disk, after disengagement of the one-revolution clutch and the turn-off of the resetting motor, be reliably turned further beyond its switching position so as to later block return of the aforementioned sliding member to its starting position; to this end, there is provided a second cam disk rigidly connected with the first cam disk. A biasing spring forwardly biases such second cam disk in order to cause the switch to be pushed to the blocking position just mentioned. The second cam disk has no influence upon the turning on of the motor switch; however, it is necessary for the release of the turn on mechanism and to make possible the turning off of the switch.

With this construction, the turning off of the pump motor is effected by reversing the control switch, thereby briefly connecting to the motor current path an electromagnet which pulls the locking element for the pump motor turn-on into the proper position.

This known construction, likewise, involves great mechanical and electromechanical complexity. Also, it lacks the indispensable safety measure in question, namely that a resetting operation, once initiated, cannot be interrupted. Furthermore, the circuit of the second functional phase can only effect a turning off of the pump motor and simultaneously of the control circuit producing this effect. Accordingly, it is not adapted for the control of a second control cycle which occurs in response to the termination of the dispensing of fuel and involves the performance of peripheral functions, such as the printing of a receipt by a printing mechanism, and the like.

Especially in the case of self-service and coin-operated fuel dispensers, the fuel dispenser should be so designed that the customer, after he fills up his fuel tank to the desired extent, is automatically given a printed receipt, without the customer having to perform any additional manipulative steps to cause such receipt to be printed and dispensed, and with the modes of operation of the various mechanisms involved being such as to preclude malfunction, especially of the type described earlier, namely interruption of the resetting operation. For printing the receipt, dispensing the receipt and then causing the receipt printer to become reset, use should be made of the control motor which is anyway present for the purpose of resetting the indicators upon removal of the dispensing nozzle from its support. However, for the control of the printer, the electrical control motor can be employed in a separate second control cycle occurring after the dispensing of fuel has been terminated. For example, this second control cycle should start automatically when the fuel dispensing nozzle is replaced onto its support, and such second control cycle should proceed to completion and not be interrupted or influenced by external manipulations such as manipulation of the support for the fuel dispensing nozzle, or the like. These requirements cannot be achieved with the known arrangements for the reasons explained above.

U.S. Pat. No. 3,447,719 discloses another arrangement for controlling the resetting motor and the pump motor in a fuel dispenser. In that arrangement, the resetting motor drives a control shaft in two discrete half-revolutions. Provided on the control shaft are a plurality of control cams. The control circuit is activated during a first half-revolution of the output shaft of the resetting motor by means of switches controlled by two cams and by means of a further switch controlled by the dispensing-nozzle support hook. During this first half-revolution, the resetting operation is performed and the winding of the pump motor switch is energized, in turn connecting the pump motor, which is arranged in a separate current path, to a current supply.

A disadvantage of this arrangement is that the control circuit requires the use of several switches whose activations must be properly timed by means of control cams. These switches are controllable only separately, making necessary various mechanical control means and the separate arrangement of the switches. Furthermore, the electrical circuit connections which can be established and disestablished by means of the switches, on account of the type of switches employed, can only be established indirectly through the force of magnetic attraction. The control components are expensive, and so are the considerable number of switch devices required, since the switches must be provided with explosion-preventing means. Furthermore, a direct dependence between the current-carrying condition of the control motor and of the pump motor does not exist, so that undesired overlaps in the energization of the two motors, such as can lead to damage of the arrangement, are not absolutely avoided. For example, the switch activated by the support hook for the dispensing nozzle may be activated to thereby close the current path for the control motor but then during the transition into the self-locking state the current path may become interrupted. Only by making the moving parts involved of sufficiently great mass, and thereby of sufficient inertia, can the currentless condition of the circuit for the control motor be overcome, until finally the corresponding holding circuit is closed. This defect, even when the moving parts involved exhibit only a low resistance to movement, can sometimes result in the entire mechanism coming to a stop.

SUMMARY OF THE INVENTION

An object of the invention is to provide an arrangement of the type in question which avoids the disadvantages of the prior art described above.

Another object of the invention is to provide an arrangement of the type in question so designed as to guarantee that the different components of the arrangement perform their respective operations in the proper sequence and with correct timing relative to each other. A related object is to avoid the possibility of overlaps in the operation of the control motor and in the turning on and off of the pump motor such as could cause damage to the arrangement.

This object, and others which will become more understandable from the description, below, of the preferred embodiment, can be met, according to one advantageous concept of the invention, by providing, a fuel dispensing arrangement comprised of a fuel dispensing nozzle, a fuel pump for pumping fuel to the fuel dispensing nozzle, an electric pump motor operative when energized by pump motor current for driving the fuel pump, a price calculator and indicator arrangement for calculating and indicating the price of the fuel pumped through the nozzle, a resetting arrangement which can be driven to effect resetting of the price calculator and indicator arrangement, and an electric control motor operative for driving the resetting arrangement. First means connects a source of electrical energy to the pump motor and defines a pump motor current path for the flow of pump motor current through the pump motor current path from the source to the pump motor. Second means connects the control motor to the pump motor current path and is operative for controlling the operation of the control motor in dependence upon the flow of pump motor current through the pump motor current path.

The inventive concepts make it possible to avoid the establishment of wrong circuit connections in the control arrangement and also make it possible to avoid the known sources of malfunction inherent in the separate control mechanisms of prior art devices of the type in question. The number of electrical components, compared to similar arrangements of the type in question, can be reduced. This is of particular importance with regard to regulations concerning anti-explosion safeguards applicable to all electrical components employed in the vicinity of the fuel tank. The components in question are far more expensive when they must satisfy the anti-explosion safeguards called for by governmental regulations than when they need not satisfy such regulations.

According to one advantageous concept of the invention, the switch activating each respective control cycle simultaneously forms part of the switch arrangement which connects the pump motor to and disconnects it from power. As a result of such double use of these control and on/off pump motor switches, the respective anti-explosion structure likewise is doubly used. Additionally, it becomes possible to reduce the mechanical complexity and to partially obviate the adjustability usually requisite for properly synchronizing the operation of the pump motor switch and a separate activating switch for the control circuit.

Advantageously, in dependence upon the effective switching state of the pump motor switch in switched off position, removal and replacement of the dispensing nozzle can only cause the resetting operation to be performed; when the pump motor switch is in switched on position, necessarily only the second cycle, for the termination of the dispensing operation, can be performed.

Advantageously, the activating switch means and the holding circuit switch means are arranged parallel to each other and complement the operation of each other in the overlapping phases of operation of the control circuit. According to the advantageous concept of the invention, it becomes possible to guarantee completion of any control phase which has begun.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS flowmeter

Figure 1:
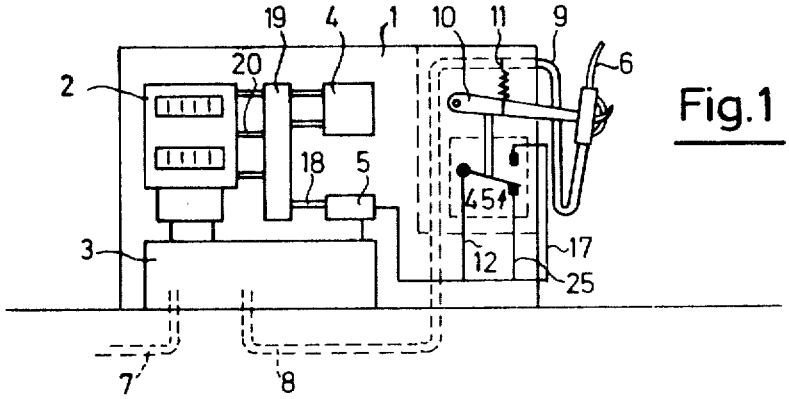
FIG. 1 is a schematic drawing of a fuel dispensing arrangement.

FIG. 1 schematically depicts a fuel dispensing arrangement. The fuel dispensing arrangement, such as might be provided at a public gas station, is comprised of a housing 1 containing a price calculator 2 positioned above a pump arrangement 3. The pump arrangement 3 consists essentially of a fuel pump, a pump motor operative for driving the pump and a conventional flowmter arrangement not explicitly illustrated in the drawing. The price calculator 2 is provided, for example, with a receipt printer 4 and an electrical control motor 5. The price calculator 2 in per se known manner is driven by the flowmeter arrangement, the fuel flowing through the flowmeter arrangement as it is pumped up from the supply tank to the gun-like dispensing nozzle 6. A conduit 7 leads from the non-illustrated fuel supply tank to the pump arrangement 3, whereas another conduit 8 leads from the pump arrangement 3 via a hose 9 to the gun-like dispensing nozzle 6.

The fuel dispensing arrangement is provided with a holding arrangement onto which the gun-like dispensing nozzle 6 is hung and from which it can be removed. In the illustrated embodiment, the holding arrangement is comprised of a hook-shaped lever 10. The lever 10 is movable between two end positions. A tension spring 11 continuously exerts an upwards pull upon the lever 10, tending to move the lever 10 against the force of gravity into the upper position. When the gun-like dispensing nozzle 6 is hung upon the hooked end of the support lever 10, the weight of the nozzle 6 pulls the lever 10 down to the lower position, against the force of tension spring 11. When the dispensing nozzle 6 is removed from the support lever 10, the tension spring 11 pulls the lever 10 to the upper position.

Connected to the lever 10 for rotation therewith is a moving switch contact K3 (FIG. 3) forming part of a two-position switch unit 45. When the lever 10 is in the upper position, because it is supporting the nozzle 6, the switch contact K3 electrically engages the stationary contact 46, thereby connecting the current supply line 12 of the control motor 5 with one of the three three-phase current supply lines 14, 15, 16 for the non-illustrated three-phase pump motor, in particular the current supply line 16. When the nozzle 6 is removed from the hooked end of the lever 10, the lever 10 moves in counterclockwise direction from the lower position of FIG. 3 to the upper position of FIG. 4. As a result, the moving switch contact K3 engages the stationary contact 44. As will become clearer below, only when the pump motor current supply circuit 14, 15, 16 is in the currentless condition does the conductor 17 become connected to the three-phase current source 23.

Figure 2:
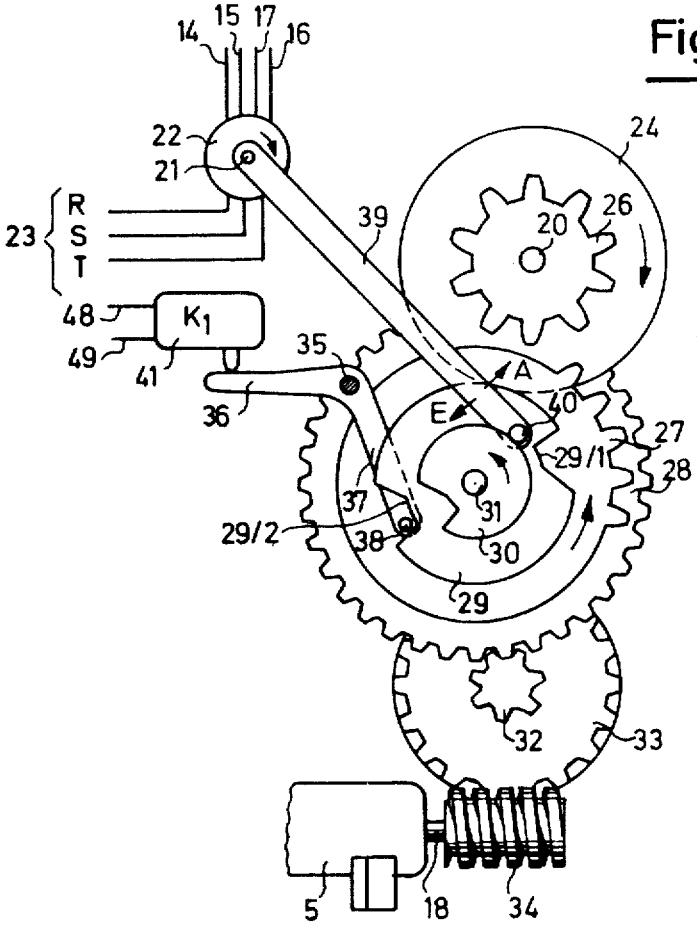
FIG. 2 is a schematic drawing of a control means incorporating gearing for the control of the operations of the various components of the fuel dispensing arrangement.

The control motor 5 via its motor shaft 18 cooperates with a control gearing arrangement 19 (FIG. 1) which in turn is connected with the resetting shaft 20 (FIGS. 1, 2) of the price calculator 2 (FIG. 1) and also with the non-illustrated resetting mechanism of the receipt printer 4. The essential components and relationships of the control gearing 19 will be clearest from FIG. 2.

The pump motor which drives the fuel pump is for example a three-phase motor having three current supply lines 14, 15, 16 (FIG. 2) connectable to the three outputs R, S, T of a three-phase current supply 23 by means of a set of three ganged switch contacts K4/1, K4/2, K4/3.

The illustrated embodiment makes use of a price calculator provided with a resetting arrangement, such as for example disclosed in German Pat. No. 1,188,334. The operations involved in the actual resetting operation are effected in per se known manner by means of a control disk 24 (FIG. 2) provided with two control cam surface portions. Each time the control disk 24 turns through an angle of 180°, a resetting operation is performed in per se known manner. In order to assure that the control disk 24 turns properly in the illustrated embodiment, the resetting shaft 20 is fixedly connected to the control disk and carries a ten-toothed gear 26. In the performance of one resetting operation, the teeth of gear 26 come into engagement with and are driven by the five gear teeth of a gear disk 27. The segment-like gear disk 27, a gear 28 and two cam disks 29, 30 are all fixedly mounted for rotation on a shaft 31. The gear 28 meshes with a pinion 32 connected with a worm wheel 33. The worm wheel 33 is engaged and driven by a worm screw 34 mounted on the motor shaft 18 of the control motor 5.

Riding on the peripheral surface of the cam disk 29 is a cam-follower roller 38 mounted at the end of an arm 37 of a two-armed lever 36 which is pivotable about a pivot axle 35. The other end of the two-armed lever 36 activates the moving contact K1 of a switch 41 (FIGS. 2, 3) against the counteracting force of a non-illustrated biasing spring which normally urges the double-armed lever 36 counterclockwise, so as to cause the cam-follower roller 38 to be pressed into engagement with the cam surface of cam disk 29.

A further lever 39 is fixedly mounted at one end on a rotatable activating shaft 21 of a pump motor switch 22. In the illustrated embodiment, the pump motor switch 22 is provided in the form of a rotary switch. The other end of lever 39 is provided with a cam follower roller 40 which rolls along the cam surface of cam disk 30. The rotary switch 22 for the pump motor is provided with non-illustrated biasing means, symbolized by the clockwise arrow. This biasing means normally urges the lever 39 in clockwise direction, so as to press the cam-follower roller 40 against the cam surface of cam disk 30.

The cam surface of cam disk is so configurated that during the rotation of the cam disk 30 the cam-follower roller 40 will be caused to move radially inwards, in the direction of arrow E, during a predetermined phase of the rotation of the cam disk 30, thereby closing the pump motor switch 22.

One rotation of the jointly rotating cam disks 29 and 30 is performed in discrete sections. In the illustrated embodiment, one rotation of the jointly rotating cam disks 29, 30 is performed in two discrete half-rotations. The performance of these two half-rotations is in turn under the control of the control motor 5. The control motor 5 is energized in two discrete cycles which, on the one hand, are controlled by the cam disk 29 and, on the other hand, control the rotation of the cam disk 29.

If the automatic operation of the arrangement is to proceed properly and reliably, then there must exist certain interrelationships, not alterable from the outside, between the two phases of operation of the control motor 5 and of the cam disk 29 during which different respective control functions are performed at the price calculator 2 and furthermore during which the pump motor switch 22 is closed and opened. These relationships are established by properly adjusting the cam disk 29 for the general control of the price calculating operations relative to the adjustment of the cam disk 30 for the control of the pump motor.

It is desired to supplement this mechanical adjustment expedient with an absolute guarantee of proper switching sequence and proper timing of the energization of the control motor 5. To this end, the manually initiatable operating cycles of the control arrangement are made dependent upon the actual state of energization of the current supply conductors 14, 15, 16 of the pump motor.

Figure 3:
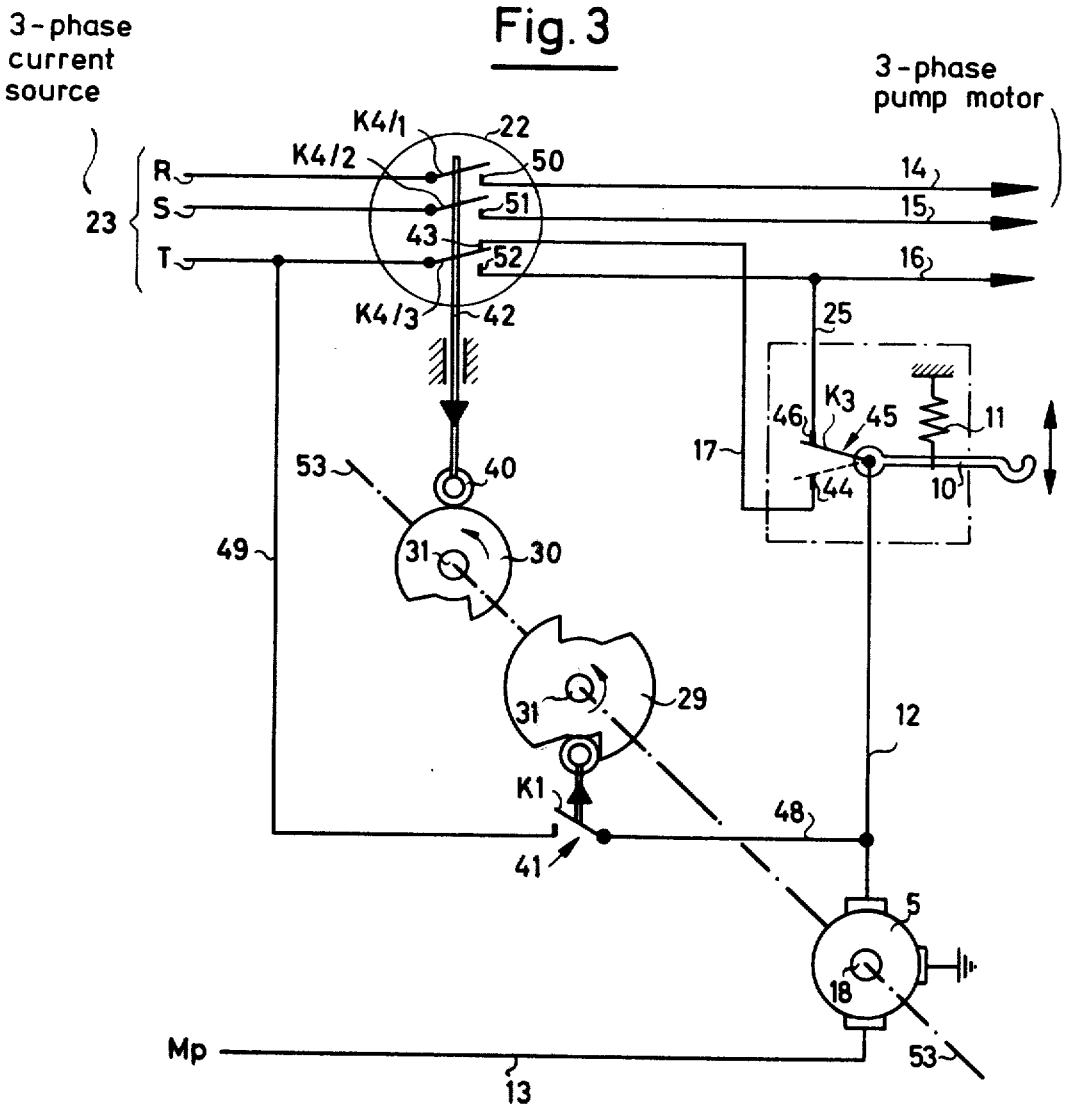
FIG. 3 depicts a control for controlling the operation of the control motor in dependence upon the state of energization of the motor of the pump of the fuel dispensing arrangement, the control circuit being depicted at the start of the first phase of the control cycle.
Figure 4:
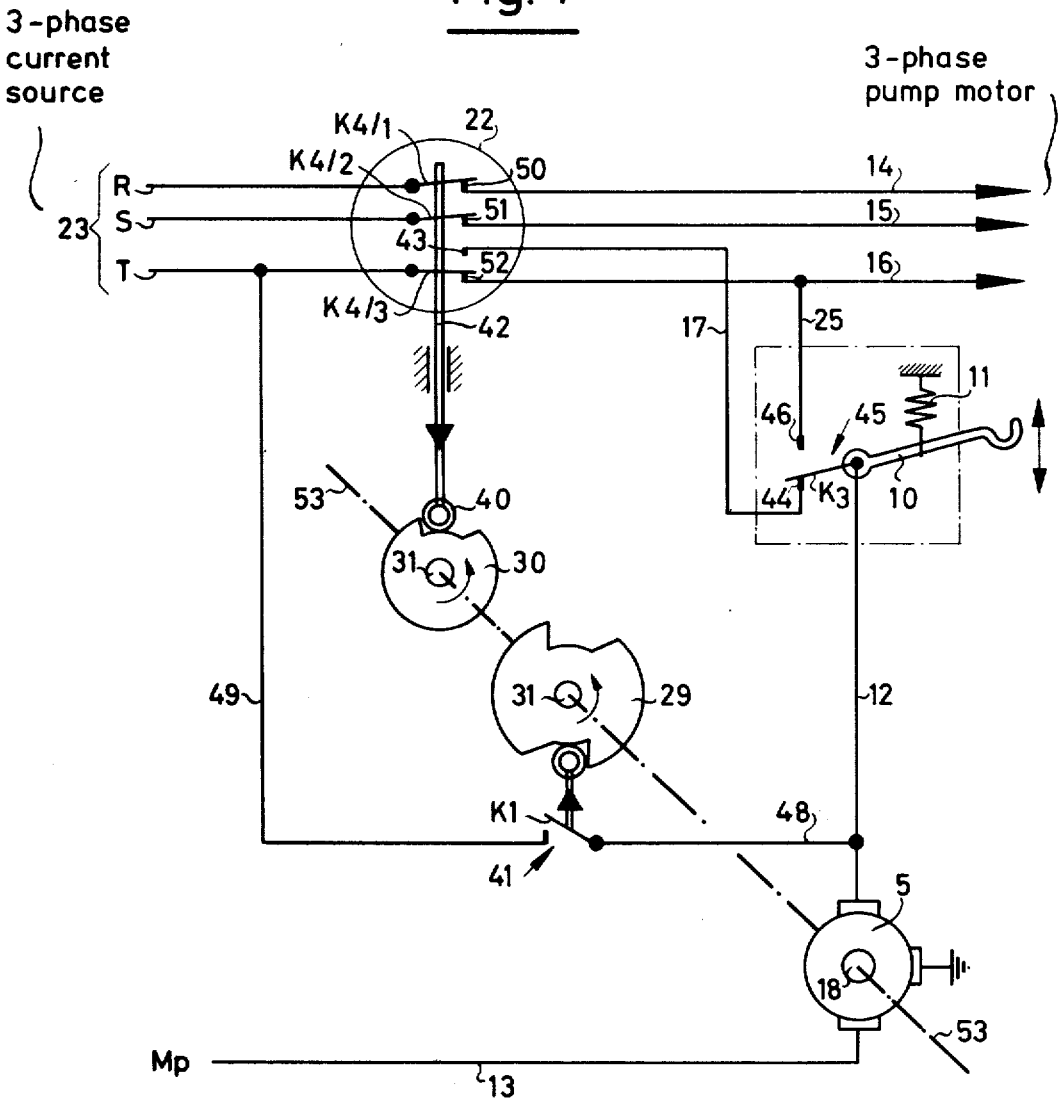
FIG. 4 depicts the circuit of FIG. 3 at the start of the second phase of the control cycle.

As can be seen in FIG. 3, the switching arrangement is comprised of three current supply lines R, S, T connected to the output of the three-phase current supply 23. The three lines R, S, T are connected to respective ones of the three inputs of pump motor switch unit 22, and accordingly connected to respective ones of the moving contacts K4/1, K4/2, K4/3. The moving contacts K4/1, K4/2, K4/3 are ganged together so as to be activatable in unison. The moving contacts K4/1, K4/2, K4/3 form together with the respective stationary contacts 50, 51, 52 three phase switches. Connected to the three outputs of the pump motor switch unit 22 are three current supply lines 14, 15, 16 connected to the three inputs of the three-phase pump motor. The pump motor current supply lines 14, 15, 16 are connectable to the three-phase current source 23 by means of the three phase switches of the pump motor switch unit 22.

Associated with one of the moving contacts, here the moving contact K4/3, is an additional stationary contact 43.

Advantageously, the contacts K4/1, K4/2, K4/3, 50, 51, 52 and 43 together form a single switch unit provided with explosion-preventing means. For example these seven contacts may be located in a common gas-tightly sealed housing filled with a protective gas. In this way, the tendency for sparks to be generated when these contacts engage and disengage each other is conteracted and, if sparks are actually produced, they are confined to the interior of the sealed housing. Other known explosion-preventing expedients can be employed.

Contact 43 is connected via conductor 17 to stationary contact 44 of manually activatable switch unit 45. The other stationary contact 46 of the manually activatable switch unit 45 is connected via a conductor 25 directly to the pump motor current supply conductor 16. As already explained, the moving contact K3 of the switch unit 45 is manually activated by removing and replacing the gun-like fuel dispensing nozzle 6. The moving contact K3 of the switch unit 45 is directly connected to the current supply conductor 12 for the control motor 5. Depending upon whether pump motor current is flowing or not, e.g., depending upon whether the pump motor switch 22 is in closed or open position, a voltage capable of driving the control motor 5 will exist on only one of the two stationary contacts 44, 46 of the manually activatable switch unit 45.

Furthermore, by applying voltage to one of the two stationary contacts 44, 46 of the switch unit 45, and with the moving contact K4/3 of the pump motor switch unit 22 in either of the two positions thereof, an external activation resulting from manipulation of the hooked lever 10 can only result in the initiation of a cycle of operation which then goes on to completion and which cannot be interrupted by futher manipulation of the lever 10.

When, as a result of removal or replacement of the dispensing nozzle 6, the switch unit applies a driving voltage to the control motor 5, the output shaft 18 of the motor 5 begins to turn. The output shaft 18 drives a further shaft 31 on which is fixedly mounted a control cam 29. The control cam 29 controls the opening and closing of a cam-controlled contact K1 of a switch 41. Specifically, once the output shaft 18 of motor 5 has begun to turn, namely at the start of one of the two operating cycles, the cam-controlled switch 41 is caused to close for the remainder of the operating cycle, thereby establishing a connection between the current supply conductor 12 of the control motor 5 and the conductors 48 and 49. The conductor 49 is permanently connected to the current supply line T. There is accordingly established an alternative or holding current path 49, 41, 48, 12 for the motor 5, thus assuring that the motor 5 will not become deenergized until after the operating cycle which has been initiated has proceeded to completion. After the operating cycle in question has been completed, the cam 29 will have reached an angular position such as to result in opening of the switch 41 and consequent interruption of the holding current circuit.

Even if for some reason the holding current path becomes improperly interrupted as a result of too early opening of the switch 41, only the one of the two control cycles which has been thusly interrupted (e.g., K3, 44 in engagement, with switch 22 still open) can be caused to proceed to completion. In every case, the single manually activatable control element, namely the switch unit 45 controlled by the lever 10, can initiate the performance of a control cycle only in dependence upon the existence or non-existence of pump motor current flow, and moreover only that one of the two control cycles can be activated by lever 10 which is associated with the prevailing pump motor current condition.

The circuit arrangement is shown in FIG. 3 prior to the start of the first control operation performed by the control motor 5. The gun-like dispensing nozzle 6 is resting on the support hook 10. Accordingly, the hook 10 is in the lower position, causing contact K3 to engage contact 46. The pump motor switch 22 is open, as illustrated, but the contact K4/3 is in electrical engagement with the additional stationary contact 43 connected to contact 44 of switch unit 45. A dispensing operation is initiated by removing the nozzle 6 from the support lever 10. This causes the moving contact K3 to electrically engage the stationary contact 44. As a result, the control motor 5 is energized and begins to turn. The control motor 5, after it is turned a little, causes the cam disk 29 to close the holding-circuit switch 41, thereby assuring energization of the control motor 5 for the entire duration of this first control operation. The first control operation is the resetting of the price calculating and indicating arrangement. The control motor 5 performs this first control operation by effecting rotation of the resetting shaft 20. In per se known manner the digit wheels of the flow meter and of the price indicator are reset to zero. Shortly after these digit wheels have been reset to zero, the control motor 5 completes the first control operation by driving the cam 30 to such a position as to cause the cam-controlled pump motor switch 22 to close, thereby establishing a flow of pump motor current. With pump motor current now flowing due to the fact that switch 22 is closed, stationary contact 43 will no longer be connected to the output terminal T of the three-phase current source 23, and accordingly a voltage capable of driving the control motor 5 will no longer be present on stationary contact 44. Instead, such a voltage will now be present on stationary contact 46 which, however, is not being electrically engaged by moving contact K3 due to the fact that the dispensing nozzle 6 has not yet been replaced on the lever 10. Accordingly, the control motor 5 continues to turn solely due to the existence of the holding current path established by closed switch 41. However, soon after the pump motor switch 22 closes, the control motor 5 causes the cam disk 29 to reopen the switch 41, and the control motor 5 accordingly stops immediately. This marks the end of the first control cycle. As will be clear, this first control operation performed by the control motor 5 essentially involves the resetting of the digit wheels of the calculators and indicators upon removal of the nozzle 6 from its support lever 10 and subsequent to such resetting the turning on of the pump motor.

The first control operation having thusly been completed, the attendant can when he is ready squeeze the trigger of the gun-like dispensing nozzle 6 and cause fuel to be dispensed.

When the attendant has finished filling the customer's fuel tank, he releases the trigger, thereby terminating the dispensing of fuel. The attendant then replaces the dispensing nozzle 6 on the support lever 10.

As a result, the support lever 10 returns to its lower position. This marks the start of the second control cycle controlled by the motor 5. Specifically, at the end of the first control cycle the pump motor had been turned on, cuased by closing of pump motor switch 22. When now, the dispensing nozzle is replaced upon the lever 10, the moving contact K3 electrically engages the stationary contact 46. Because pump motor current is flowing through pump motor current conductor 16, there exists on stationary contact 46 a voltage capable of driving the control motor 5. Accordingly, when the nozzle 6 is replaced, and because the pump motor current is still flowing, the control motor begins to turn, thereby commencing the performance of the second control cycle.

As the motor 5 starts to turn again, during this second control cycle, it again causes the cam disk 29 to close the switch 41, to again establish the holding current circuit T, 49, 41, 48, 12, 5, 13. Thus, during the second control cycle, as during the first control cycle, an auxiliary current path is provided for the control motor 5, assuring that the second control cycle will proceed to completion, irrespective of possible manipulation of lever 10.

As the motor 5 turns further, it causes cam disk 30 to reopen the pump switch 22, and pump motor current ceases to flow. Thus, it is only during the initial portion of the second control cycle that the fuel pump continues in operation. The fuel pump is allowed to continue in operation in order to assist in the proper timing and initiation of the second control cycle. However, once the second control cycle has been initiated, operation of the fuel pump is no longer required, and is terminated in this embodiment.

With the pump motor switch 22 now open again, a driving voltage capable of driving control motor 5 no longer exists on stationary contact 44; it now exists on stationary contact 46. Accordingly, the control motor 5 continues to turn solely due to the existence of the auxiliary or holding current circuit T, 49, 41, 48, 5, 13.

As the control motor 5 continues to turn during this second control operation, it will drive various auxiliary devices. In the present embodiment, as the control motor 5 continues to turn during the second control operation, it drives the receipt printer arrangement 4, causing the latter to print a receipt. Then dispense the receipt and finally become reset.

After the auxiliary device, such as the printing arrangement 4, has performed its respective function, the output shaft of control motor 5 turns still further, causing the cam disk 29 to reopen the switch 41, thereby interrupting the holding current circuit, and causing the control motor 5 to cease operation. The second control cycle or control operation of the control motor 5 is now completed.

It will be understood that each of the elements described above, or two or more together, may also find a useful application in other types of circuits and constructions differing from the types described above.

While the invention has been illustrated and described as embodied in a fuel dispensing arrangement for use in a public gas station or the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is:

1. In a fuel dispensing arrangement of the type comprised of a fuel dispensing nozzle, a fuel pump for pumping fuel to said fuel dispensing nozzle, an electric pump motor operative when energized by pump motor current for driving said fuel pump, a price calculator and indicator arrangement for calculating and indicating the price of the fuel pumped through said nozzle, a resetting arrangement which can be driven to effect resetting of said price calculator and indicator arrangement, and an electric control motor operative for driving said resetting arrangement, in combination therewith, a source of electrical energy; first means connecting said source of electrical energy to said pump motor and defining a pump motor current path for the flow of pump motor current through said pump motor current path from said source to said pump motor; and second means connecting said control motor to said pump motor current path and operative for controlling the operation of said control motor in dependence upon the flow of pump motor current through said pump motor current path.

2. In a fuel dispensing arrangement as defined in claim 1, wherein said fuel dispensing nozzle has a rest position and a working position, and wherein said second means comprises means for controlling the operation of said control motor in dependence upon both the flow of pump motor current through said pump motor current path and upon the position of said fuel dispensing nozzle.

3. In a fuel dispensing arrangement as defined in claim 1, wherein said fuel dispensing arrangement is provided with a two-position nozzle support which assumes a first position when supporting said nozzle and which assumes a second position when said nozzle is removed from said nozzle support, and wherein said second means comprises means for controlling the operation of said control motor in dependence upon both the flow of pump motor current through said pump motor current path and upon the position of said two-position nozzle support and including a switch mechanically connected to and activated by said two-position nozzle support and electrically connecting said control motor to said pump motor current path.

4. In a fuel dispensing arrangement as defined in claim 1, wherein said first means comprises a pump motor switch having a first terminal electrically connected to one terminal of said source of electrical energy and having a second terminal electrically connected to one terminal of said pump motor, and wherein said second means includes a conductor having one end electrically connected to said second terminal of said pump motor switch and having a second end, and means for establishing a complete current path for said control motor by connecting said second end of said conductor to one terminal of said control motor.

5. In a fuel dispensing arrangement of the type comprised of a fuel dispensing nozzle, a fuel pump for pumping fuel to said fuel dispensing nozzle, an electric pump motor operative when energized by pump motor current for driving said fuel pump, a price calculator and indicator arrangement for calculating and indicating the price of the fuel pumped through said nozzle, a resetting arrangement which can be driven to effect resetting of said price calculator and indicator arrangement, and an electric control motor operative for driving said resetting arrangement, in combination therewith, a source of electrical energy; first means connecting said source of electrical energy to said pump motor and defining a pump motor current path for the flow of pump motor current through said pump motor current path from said source to said pump motor; and second means connecting said control motor to said pump motor current path and operative for controlling the operation of said control motor in dependence upon the flow of pump motor current through said pump motor current path, wherein said fuel dispensing arrangement further includes an auxiliary arrangement which can be driven by said control motor, and wherein said control motor is operative for performing a first operation in which it drives said resetting arrangement and a separate second operation in which it drives said auxiliary arrangement, and wherein said fuel dispensing nozzle has a rest position and a working position, and wherein said second means comprises means operative for initiating the performance by said control motor of said first operation in response to the assumption by said nozzle of said working position but only when there is no flow of pump motor current and means operative for initiating the performance by said control motor of said second operation in response to the assumption by said nozzle of said rest position but only when there is a flow of pump motor current.

6. In a fuel dispensing arrangement as defined in claim 5, wherein said second means further comprises holding current circuit means operative in response to the initiation of the performance by said control motor of one of said operations for providing said control motor with a complete current path for the duration of such operation independently of the flow of pump motor current and independently of the position of said nozzle.

7. In a fuel dispensing arrangement of the type comprised of a fuel dispensing nozzle, a fuel pump for pumping fuel to said fuel dispensing nozzle, an electric pump motor operative when energized by pump motor current for driving said fuel pump, a price calculator and indicator arrangement for calculating and indicating the price of the fuel pumped through said nozzle, a resetting arrangement which can be driven to effect resetting of said price calculator and indicator arrangement, and an electric control motor operative for driving said resetting arrangement, in combination therewith, a source of electrical energy; first means connecting said source of electrical energy to said pump motor and defining a pump motor current path for the flow of pump motor current through said pump motor current path from said source to said pump motor; and second means connecting said control motor to said pump motor current path and operative for controlling the operation of said control motor in dependence upon the flow of pump motor current through said pump motor current path, wherein said fuel dispensing arrangement further includes a printing arrangement which can be driven by said control motor and which is operative when so driven for printing and dispensing a customer's receipt, and wherein said control motor is operative for performing a first cycle of operation in which it drives said resetting arrangement and a separate second cycle of operation in which it drives said printing arrangement, and wherein said fuel dispensing nozzle has a rest position and a working position, and wherein said second means comprises means operative for initiating the performance by said control motor of said first operation in response to the assumption by said nozzle of said work position but only when there is no flow of pump motor current and means operative for initiating the performance by said control motor of said second operation in response to the assumption by said nozzle of said rest position but only when there is a flow of pump motor current.

8. In a fuel dispensing arrangement of the type comprised of a fuel dispensing nozzle, a fuel pump for pumping fuel to said fuel dispensing nozzle, an electric pump motor operative when energized by pump motor current for driving said fuel pump, a price calculator and indicator arrangement for calculating and indicating the price of the fuel pumped through said nozzle, a resetting arrangement which can be driven to effect resetting of said price calculator and indicator arrangement, and an electric control motor operative for driving said resetting arrangement, in combination therewith, a source of electrical energy; first means connecting said source of electrical energy to said pump motor and defining a pump motor current path for the flow of pump motor current through said pump motor current path from said source to said pump motor; and second means connecting said control motor to said pump motor current path and operative for controlling the operation of said control motor in dependence upon the flow of pump motor current through said pump motor current path, wherein said first means includes a pump motor switch comprising a moving first contact electrically connected to one terminal of said source of electrical energy and a stationary second contact electrically connected to one terminal of said pump motor, and wherein said second means includes a stationary third contact cooperating with said moving first contact and electrically engaged by the latter when said moving first contact is not in electrical engagement with said stationary second contact and a conductor having one end electrically connected to said third contact and having a second end, and means for establishing a complete current path for said control motor by connecting said second end of said conductor to one terminal of said control motor.

9. In a fuel dispensing arrangement of the type comprised of a fuel dispensing nozzle, a fuel pump for pumping fuel to said fuel dispensing nozzle, an electric pump motor operative when energized by pump motor current for driving said fuel pump, a price calculator and indicator arrangement for calculating and indicating the price of the fuel pumped through said nozzle, a resetting arrangement which can be driven to effect resetting of said price calculator and indicator arrangement, and an electric control motor operative for driving said resetting arrangement, in combination therewith, a source of electrical energy; first means connecting said source of electrical energy to said pump motor and defining a pump motor current path for the flow of pump motor current through said pump motor current path from said source to said pump motor; and second means connecting said control motor to said pump motor current path and operative for controlling the operation of said control motor in dependence upon the flow of pump motor current through said pump motor current path, wherein said first means includes a pump motor switch comprising a moving first contact electrically connected to one terminal of said source of electrical energy and a stationary second contact electrically connected to one terminal of said pump motor, and wherein said second means includes a stationary third contact cooperating with said moving first contact and electrically engaged by the latter when said moving first contact is not in electrical engagement with said stationary second contact, a first conductor having a first end electrically connected to said third contact and having a second end, a second conductor having a first end electrically connected to said second contact and having a second end, and means for establishing a complete current path for said control motor by alternatively connecting said second end of said first conductor to one terminal of said control motor or else by connecting said second end of said second conductor to one terminal of said control motor.

10. In a fuel dispensing arrangement as defined in claim 9, wherein said fuel dispensing arrangement is provided with a two-position nozzle support which assumes a first position when supporting said nozzle and which assumes a second position when said nozzle is removed from said nozzle support, and wherein said means for establishing a complete current path for said control motor comprises switch means connected to and activated by said two-position nozzle support and operative when said nozzle support assumes said first position for establishing a complete current path for said control motor by connecting said second end of said second conductor to one terminal of said control motor and operative when said nozzle support assumes said second position for establishing a complete current path for said control motor by connecting said second end of said first conductor to one terminal of said control motor.

11. In a fuel dispensing arrangement as defined in claim 10, wherein said switch means comprises a first stationary contact connected to said second end of said first conductor and a second stationary contact connected to said second end of said second conductor and a moving contact mechanically connected to and activated by said two-position nozzle support and movable into alternate engagement with said first and second contacts of said switch means electrically connected to one terminal of said control motor.

12. In a fuel dispensing arrangement as defined in claim 9, wherein said moving first contact and said stationary second and third contacts together form part of a single switch unit provided with explosion-preventing means.

13. In a fuel dispensing arrangement as defined in claim 9, wherein said source of electrical energy is a polyphase current source, wherein said pump motor is a polyphase motor, wherein said first means includes a plurality of ganged-together moving first contacts electrically connected to respective terminals of said polyphase current source and a corresponding plurality of stationary second contacts electrically connected to respective terminals of said polyphase pump motor, and wherein said second means includes a stationary third contact cooperating with one of said moving first contacts and electrically engaged by said one of said moving first contacts when said one of said moving first contacts is not in electrical engagement with the respective one of said stationary second contacts, a first conductor having a first end electrically connected to said third contact and having a second end, a second conductor having a first end electrically connected to the one of said second contacts associated with said one of said first contacts and having a second end, and means for establishing a complete current path for said control motor by alternatively connecting said second end of said first conductor to one terminal of said control motor or else by connecting said second end of said second conductor to one terminal of said control motor, and wherein said first, second and third contacts together form part of a single switch unit provided with explosion-preventing means.

* * * * *